United States Patent [19]

Puerner

[11] Patent Number: 4,921,442

[45] Date of Patent: May 1, 1990

[54] HOUSING FOR FLAT POWER CABLE CONNECTOR

[75] Inventor: Dean A. Puerner, Maricopa, Ariz.

[73] Assignee: AMP Incorporated, Harrisburg, Pa.

[21] Appl. No.: 386,536

[22] Filed: Jul. 28, 1989

Related U.S. Application Data

[63] Continuation-in-part of Ser. No. 338,790, Apr. 14, 1989, abandoned.

[51] Int. Cl.[5] ..... H01R 13/00

[52] U.S. Cl. ..... 439/499

[58] Field of Search ..... 439/492–499

[56] References Cited

U.S. PATENT DOCUMENTS

| | | | |
|---|---|---|---|
| 3,573,719 | 4/1971 | Lightner | 339/196 |
| 3,601,768 | 8/1971 | Lightner | 339/103 M |
| 4,211,466 | 7/1980 | Reynolds | 439/499 |
| 4,382,652 | 5/1983 | Sinclair | 439/499 |
| 4,475,786 | 10/1984 | Root et al. | 339/99 R |
| 4,655,525 | 4/1987 | Hunt, III et al. | 339/63 M |
| 4,687,263 | 8/1987 | Cosmos et al. | 439/499 |
| 4,713,021 | 12/1987 | Kobler | 439/272 |
| 4,740,867 | 4/1988 | Roberts et al. | 439/499 |
| 4,787,864 | 11/1988 | Hunt, III et al. | 439/595 |

*Primary Examiner*—Joseph H. McGlynn
*Attorney, Agent, or Firm*—Anton P. Ness

[57] ABSTRACT

A housing for a termination of a terminal or pair of terminals onto an end of flat power cable has a pair of wide terminal-receiving cavities to receive the terminated cable end from rearwardly thereof, for contact sections of the terminal or terminals to extend forwardly from or be exposed along the forward housing mating face. A rearward cover member is then securable to the rearward end of the housing such as by latching thereto, to secure the terminals within the cavities and define a cable exit spaced rearwardly of the terminations of the terminal or terminals. The rearward cover member can be bifurcated having upper and lower struts joined at one lateral end thereof to be inserted over the flat cable from one side, and a latch arm extends forwardly from the joined end and a pair of adjacent latch arms extend forwardly from the unjoined ends of the struts, for latching to the housing, and the adjacent latch arms after latching act as a single latch arm.

16 Claims, 10 Drawing Sheets

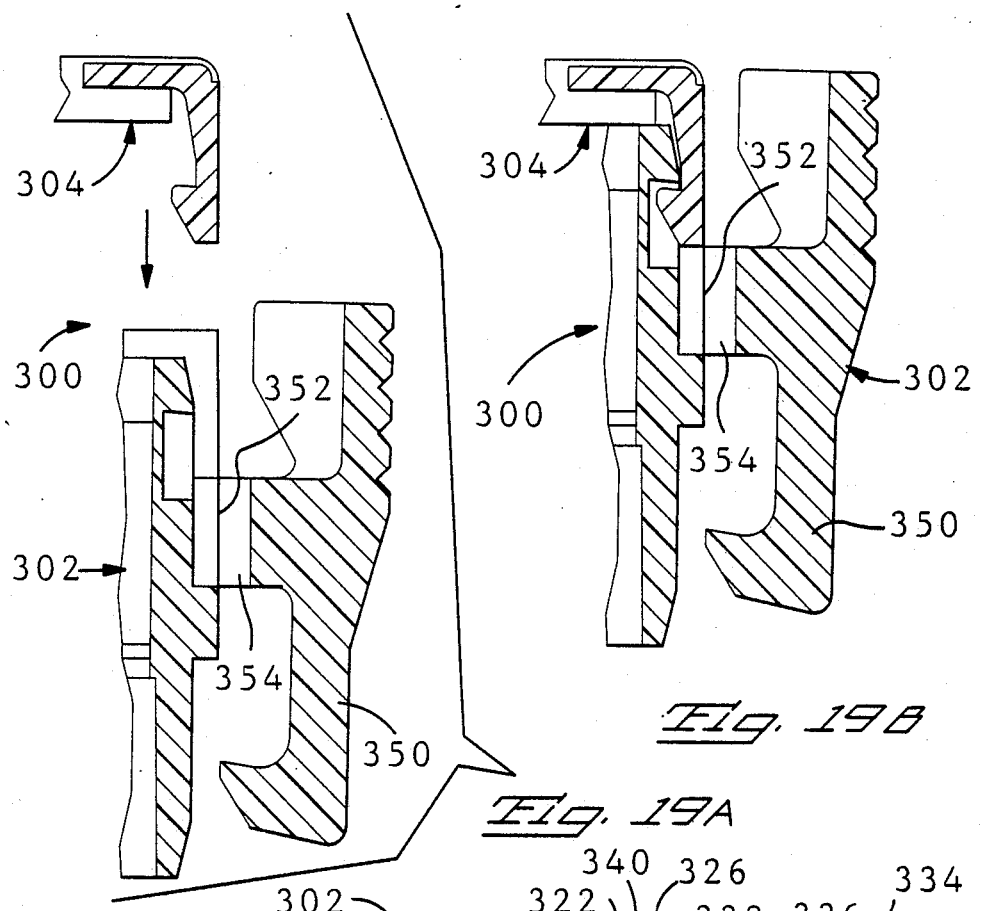
Fig. 19B
Fig. 19A
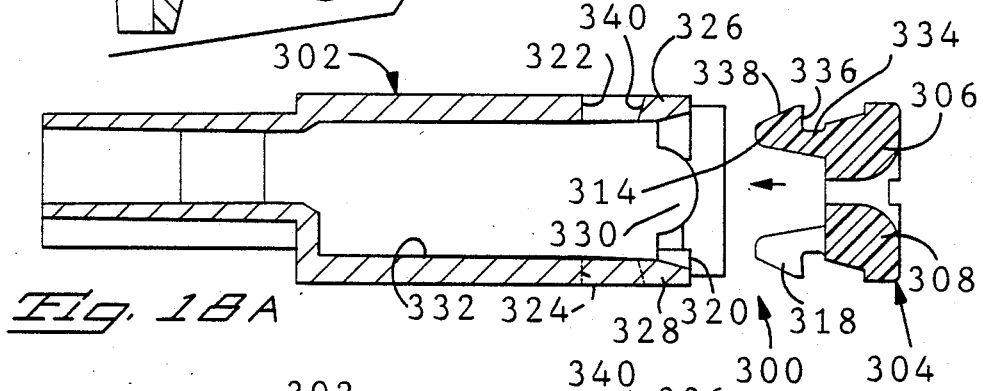
Fig. 18A
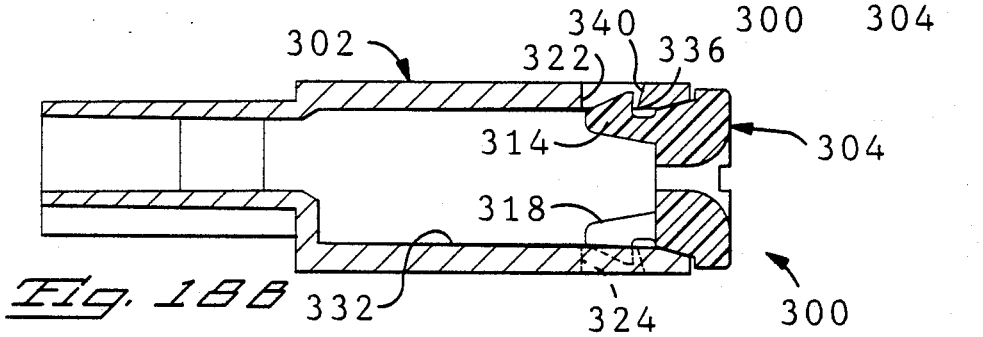
Fig. 18B

HOUSING FOR FLAT POWER CABLE CONNECTOR

REFERENCE TO RELATED APPLICATION

This is a continuation-in-part of U.S. patent application Ser. No. 07/338,790 filed Apr. 14, 1989.

FIELD OF THE INVENTION

The present invention relates to the field of electrical connectors and more particularly to terminating flat power cables.

U.S. patent applications Ser. Nos. 07/298,259, 07/193,852 and 07/194,063 disclose a transition adapter which is crimped onto a flat power cable by penetrating the insulation covering the cable's conductor and also shearing through the conductor at a plurality of locations. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. One embodiment of the transition adapter is stamped and formed of sheet metal and in one embodiment includes a pair of opposing plate sections disposed along respective major surfaces of the cable and including opposing termination regions extending transversely across the cable. Each terminating region includes a transverse array of alternating shearing wave shapes and relief recesses of equal width, the relief recesses defined by arcuate projections extending away from the cable-proximate side, and the wave shapes extending outwardly from the cable-proximate side and toward relief recesses in the opposed plate section. Each shearing wave shape has a transverse crest between parallel side edges, and the side edges of the corresponding relief recesses are associated with the wave side edges to comprise pairs of shearing edges, preferably with zero clearance. When the plate sections are pressed against a cable section disposed therebetween the crests of the wave shapes initiate cable shearing by their axially oriented side edges cutting through the cable insulation and into and through the metal conductor. The wave shapes extrude the sheared cable strips outwardly into the opposing relief recesses as the shears propagate axially along the cable for limited distances, forming a series of interlocking wave joints with the cable while exposing newly sheared edges of the cable conductor for electrical connection therewith.

Further with regard to the transition adapter of the above applications, fastened to the outwardly facing surface of the plate sections at the terminating regions are respective inserts of low resistance copper. The inserts have adapter-facing surfaces conforming closely to the shaped outer surface of the terminating region, with alternating wave shapes and apertures disposed outwardly of and along the adapter's shearing wave shapes and relief recesses. Upon termination the wave joints are within the insert apertures, and the sheared edges of the adjacent conductor strips and of the adapter wave shapes which formed the sheared strips are adjacent to side surfaces of the copper insert apertures. A two-step staking process is preferred: in a first step the wave joints are split axially so that portions of each arcuate shape of both adapter plate sections are forced inwardly against the adjacent sheared conductor strip of the respective wave joint to define spring fingers whose ends pin the conductor strip against the opposing wave crest to store energy in the joint; and in the second step a staking process deforms the insert between the sheared strips to deform the copper against the sheared conductor and wave shape edges, forming gas-tight, heat and vibration resistant electrical connections with the cable conductor and with the transition adapter, so that the inserts are electrically in series at a plurality of locations between the conductor and the adapter.

A contact section is integrally included on the transition adapter enabling mating with corresponding contact means of an electrical connector, or a bus bar, or a power supply terminal, for example, and can include a plurality of contact sections to distribute the power to a corresponding plurality of contact means if desired. One such contact section is disclosed in U.S. patent application Ser. No. 07/233,684 filed Aug. 18, 1988 and assigned to the assignee hereof. A housing or other dielectric covering can be placed around the termination as desired. One such housing is disclosed in U.S. patent application Ser. No 07/234,063 filed Aug. 18, 1988 and assigned to the assignee hereof.

Also entering commercial acceptance is a dual conductor flat cable, wherein a pair of parallel spaced coplanar flat conductor strips having insulation extruded therearound define power and return paths for electrical power transmission. One method has been devised as disclosed in U.S. Pat. No. 4,241,498 which involves a member associated with one of the two conductors having upper and lower sections joined at a tab. The upper and lower sections are brought along the upper and lower surfaces of the conductor from the side of the cable so that the tab is disposed laterally of the cable. The upper and lower sections have semicylindrical metallic jaws having alternating grooves and lands with the grooves of one jaw adapted to receive thereinto the lands of the opposing jaw when the upper and lower sections are pressed against the conductor. The lands shear strips of the conductor and extrude the sheared strips into the opposing grooves, in a punch and die process. After termination the sheared conductor edges are disposed adjacent sides of the grooves of the semicylindrical jaws to form electrical connections therewith. The tab extends laterally from the cable and is exposed for electrical engagement therewith by another electrical article. The other conductor may be similarly terminated at a nearby location.

It is desired to provide housing means for a connector having terminals terminated to single or dual conductor flat power cable.

It is also desired to provide a means for cable strain relief included by the connector.

It is further desirable for the connector housing to provide means for limiting axial and vertical movement of the terminals within the housing.

SUMMARY OF THE INVENTION

The present invention comprises a housing means for a pair of transition adapter terminals terminated adjacent each other to an end of flat power cable, to define an electrical connector. The pair of terminals and the housing therefor may be used with single conductor flat power cable but are especially suitable for terminating dual conductor flat power cable. The terminals include contact sections extending forwardly from the cable end and extending forwardly from or otherwise exposed along the mating face of the housing for electrical connection with corresponding contact means of another electrical article such as another cable connector, a header mounted on a printed circuit board, terminal posts of a power supply, or a bus bar.

Each terminal is of the type having a pair of opposed plate sections transversely across each of which are an array of shearing wave shapes alternating with relief recesses, so that when the pair of plate sections disposed against major surfaces of the flat cable at an end thereof are pressed together and against the cable therebetween, the arrays of shearing wave shapes cooperate to shear the conductor of the flat cable into a plurality of strips which remain integral with the cable. The wave shapes also extrude the newly sheared conductor strips into the opposing relief recesses so that newly sheared conductor edges are moved adjacent electrical engagement surfaces defined by the vertical side edges of the adjacent shearing wave shapes forming electrical connections of the adapter terminals with the flat cable conductors.

The pair of plate sections of each terminal both extend forwardly from a rearward cable-receiving terminal end where they coextend forwardly at a slight angle from a pair of bight sections spaced laterally apart defining a cable-receiving slot therebetween of known transverse width. Tab-shaped portions are formed on the end section of the cable and are inserted through the cable-receiving slots of the terminals and are disposed between upper and lower plate sections of each terminal. The upper and lower plate sections of each pair are pressed respectively together by being rotated about the bight sections which act as integral hinges, so that the shearing wave shapes shear and extrude strips of the conductor (or conductors) of the cable forming a termination of the terminals to the cable.

The two tab-shaped cable portions fit through the terminal slots with no more than a slight clearance with the inside edges of the pair of bight sections of each terminal, as is disclosed in U.S. patent application Ser. No. 07/338,079 filed Apr. 14, 1989 and assigned to the assignee hereof. More importantly, the exposed axial conductor edges are formed precisely to be adjacent outwardly facing edges of the inner ones of the bight sections of the respective terminals. When the terminal plate sections are pressed together terminating the cable, the inner bight section already at least adjacent the conductor edge along the cable slot is deformed slightly against the conductor edge thereby biting into the metal, while the outer bight section is deformed slightly against and into the insulative coating along the adjacent lateral outer edge of the cable, thus gripping the tab-shaped cable portions after termination to act as stop mechanisms against axial movement of the terminals with respect to the cable and relieving stress on the terminations.

The terminals terminated to the tab-shaped cable portions are insertable into respective openings at the rearward end of a housing member until the terminals are disposed within respective cavities and the contact sections are disposed appropriately along the housing mating face. The housing member of the connector of the present invention is preferably molded as an integral member to precisely define upper and lower pairs of terminal-proximate ledges of precisely fixed spacing. The pairs of ledges maintain each of the terminals closely positioned vertically within their respective cavities to assist in minimizing detrimental effects of vibration on the terminations and are assisted in that function by a central rib between the cavities joining the upper and lower housing cover portions. A rearward cover member is then securable to the rearward housing end to define a cable exit, and includes rearward stop surfaces to maintain the terminals properly positioned axially within the housing, maintaining the contact sections in position axially to enhance wear resistance of the contact surfaces by minimizing axial movement thereof.

The rearward cover member of the connector of the present invention is preferably integrally molded of plastic and bifurcated having upper and lower transverse struts joined at one lateral end, to be inserted over the flat cable from one side thereof after termination by the terminals. The member has a pair of latch arms each extending forwardly from a respective lateral end, which latchingly engage the housing when moved forwardly along the cable and against the rearward end of the housing. One of the latch arms is an integral member at the integrally joined lateral end while the other is split horizontally comprising upper and lower arm sections respectively extending forwardly from the lateral ends of the upper and lower struts at the split lateral end. When latched upper and lower arm sections are firmly held together vertically by the latching recess of the housing, and the rearward cover member then closely fits against the flat cable disposed between the upper and lower struts, with curved cable-proximate edges to maintain the integrity of the cable insulation during handling and in the event the cable is bent or stressed vertically into a perpendicular orientation.

In one embodiment of housing, the rearward cover member includes pairs of upper and lower latching sections extending upwardly and downwardly from arms extending forwardly from the upper and lower struts and defining rearwardly facing latching surfaces. The upper and lower latching sections are received into corresponding latching recesses of the housing member just forwardly of the rearward face, when the rearward cover member is latched to the rearward end of the housing member. To assist in being received into the large cavities, the latching sections can have forwardly and outwardly facing angled surfaces which elastically deform, or deflect outwardly the engaged portions of the upper and lower cavity wall portions as the latching sections ride between the upper and lower cavity wall portions rearwardly of the latching recesses. The upper and lower latching sections are located near the center of the rearward face and act to hold the central portions of the struts against the rearward housing end when rearward stress is applied on the rearward cover member by the terminated flat cable, and the upper and lower latching sections also serve to maintain the central portions of the struts against upward and downward deflection upon being stressed by the cable.

It is an objective of the present invention to provide a housing for terminals terminated onto an end of flat power cable.

It is also an objective for such a housing to accommodate a system of terminals simultaneously for either single or dual conductor flat power cable.

It is a further objective to provide a housing which is adapted to secure the terminals substantially against vertical movement therewithin and to secure the terminals substantially against axial movement therewithin.

It is yet a further objective to provide a rearward cover member securable to the rearward end of an integral housing after the terminated cable end is received into the housing from rearwardly thereof.

It is still further an objective to provide such a rearward cover member which is an integral member latchable to the housing and which snugly fits about the flat cable.

Embodiments of the housing and rearward cover members will now be specifically described with reference to the accompanying drawings.

BRIEF DESCRIPTION OF THE DRAWINGS

FIGS. 18A and 18B are longitudinal section views of the housing and rearward cover members of FIG. 17 before and after being latched together, with FIG. 18A being taken along lines 18A—18A of FIG. 17; and FIGS. 19A and 19B are part plan views of another configuration of latch arm of the housing for latching to a mating connector, before and after the rearward cover member is secured to the housing member, with FIG. 19A being taken along lines 19A—19A of FIG. 17.

DETAILED DESCRIPTION OF THE PREFERRED EMBODIMENTS

Figure 1:
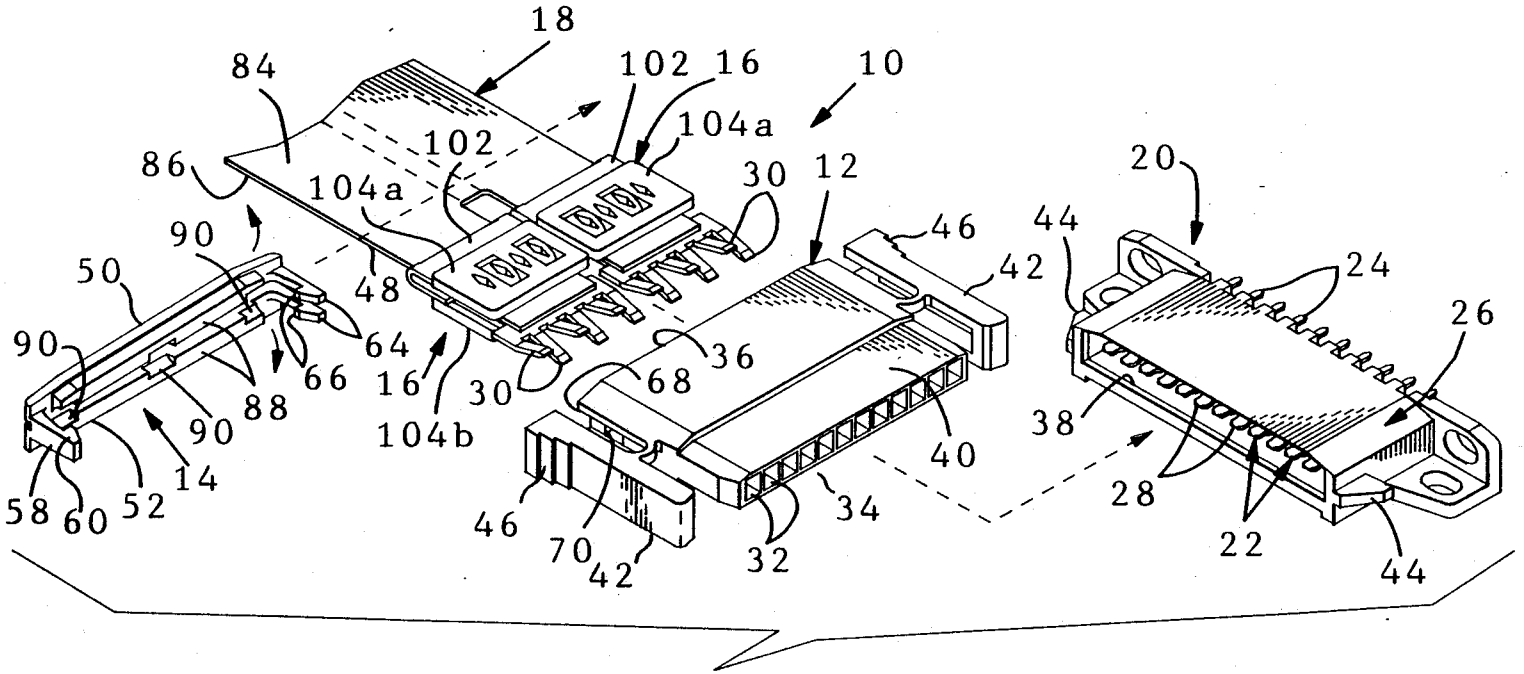
FIG. 1 is a perspective view of the connector of the present invention, and a connector matable therewith, with the terminated flat cable exploded from the housing and a rearward cover member exploded from the connector.

Connector 10 of FIG. 1 includes a housing member 12 and rearward cable exit or cover member 14, adapted to house a pair of terminals 16 terminated onto flat power cable 18. Connector 20 is matable with connector 10 and is adapted to house a corresponding pair of terminals 22 which are shown to include post sections 24 extending rearwardly from housing 26 for insertion into corresponding plated through-holes of a printed circuit board (not shown). Terminals 22 also are shown having spring arm contact sections 28 at forward ends thereof matable with splines 30 at forward ends of terminals 16, when connectors 10 an d 20 are mated. Housing 12 includes a plurality of forward passageways 32 in communication with mating face 34 within each of which is disposed a spline 30 after terminals 16 are inserted into housing member 12 from rearward end 36. Housing 26 of connector 20 includes a large cavity 38 within which are disposed spring arms 28, and large cavity 38 is adapted to receive thereinto forward section 40 of housing 12 of connector 10 upon mating, with spring arms 28 received within passageways 32 to electrically engage respective splines 30. Housing 12 is shown having a pair of latch arms 42 along sides thereof which ride over and latchingly engage a pair of corresponding latching projections 44 of housing 26 to secure the connectors together. Latch arms 42 are shown having rearward gripping portions 46 deflectable inwardly to facilitate delatching from projections 44 upon connector unmating.

Figure 2:
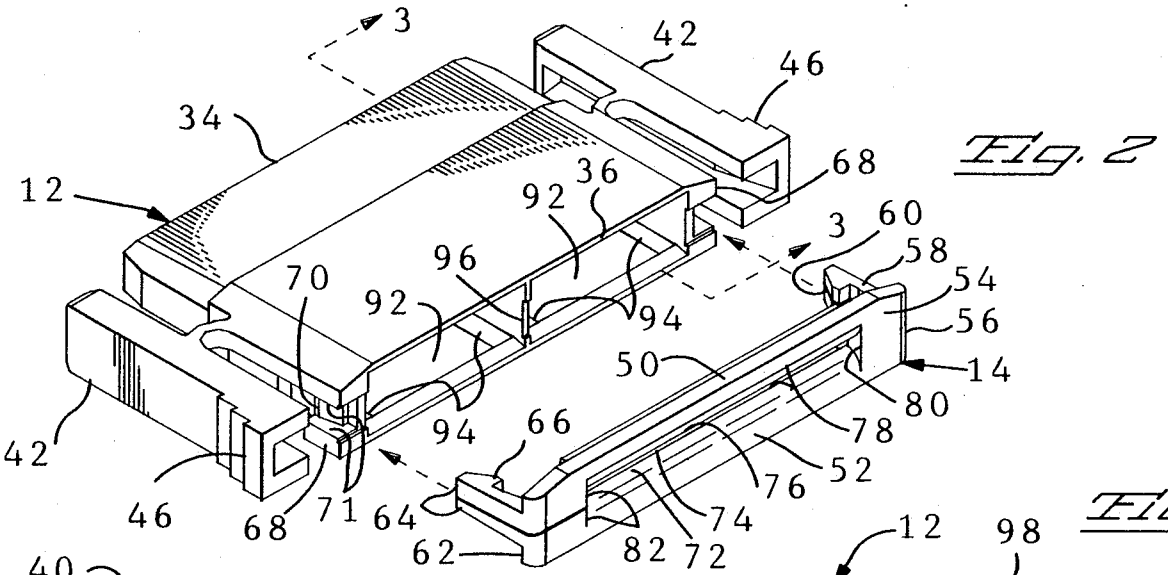
FIG. 2 is a perspective view of the housing and rearward cover member of FIG. 1 from rearwardly thereof.

Referring to FIGS. 1 and 2, after terminals 16 on cable 18 are inserted into rearward housing end 36, rearward cover member 14 is insertable across flat cable 18 from lateral edge 48 and then movable forwardly therealong to latch securely to housing member 12 along rearward end 36 Rearward cover member 14 includes upper and lower struts 50,52 extending laterally from integral section 54 spaced slightly apart for cable 18 eventually to be disposed therebetween. At lateral end 56 including integral section 54, first latch arm 58 extends forwardly to inwardly directed latching projection 60. At lateral end 62 a pair of second latch arms 64 extend forwardly from ends of upper and lower struts 50, 52 to inwardly directed latching projections 66 which will cooperate as a single latch arm during latching to connector housing 12. Housing member 12 includes near rearward end 36 and along outer surfaces 68 a pair of latching recesses 70 in channels defined between upper and lower channel wall surfaces 71, for receiving thereinto latching projections 60,66,66 when rearward cover member 14 is secured to housing member 12.

Figure 13:
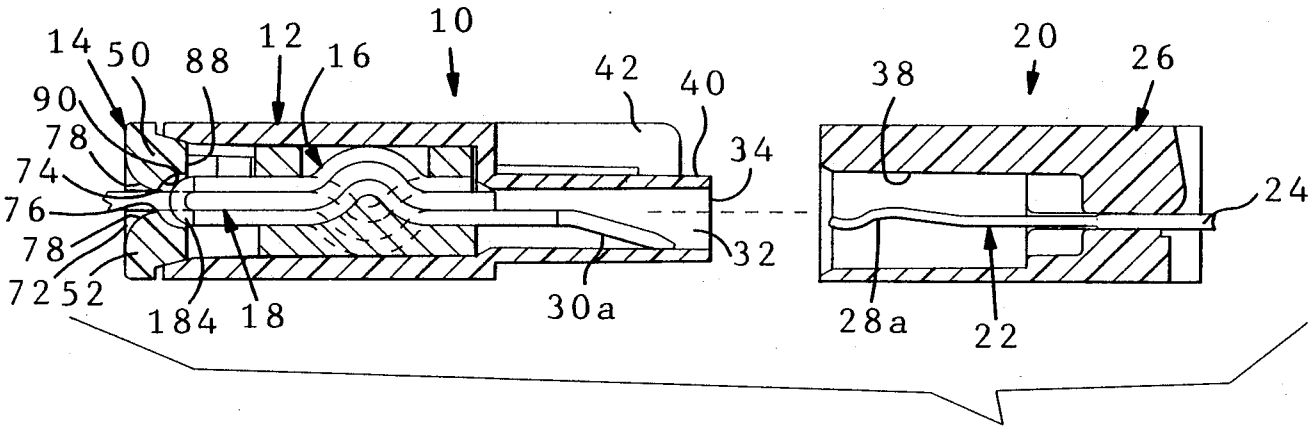
FIGS. 13 and 14 are elevation section views of the connectors of FIGS. 11 and 12 taken along lines 13—13 and 14—14 respectively thereof, unmated and mated.
Figure 14:
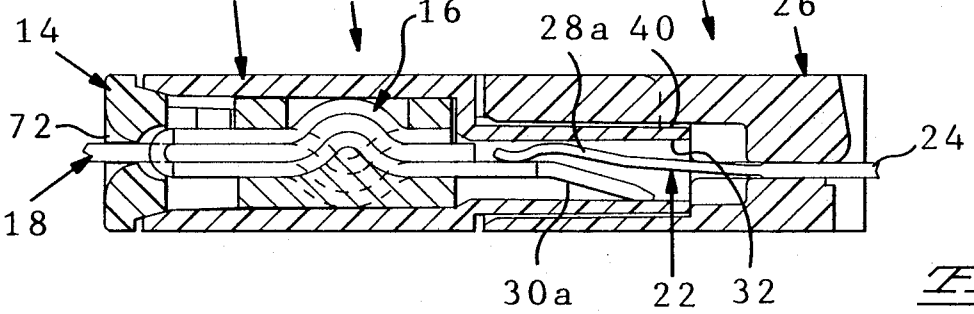

Upon assembly to housing member 12 rearward cover member 14 defines a cable exit or slot 72 between facing surfaces 74,76 of upper and lower struts 50,52 with rounded rearward corners 78 and between side walls 80,82,82 near lateral ends 56,62 respectively. The distance between side walls 80,82,82 is preferably selected to be slightly less than the nominal width of cable 18 to generate a slight interference fit width wise after connector assembly. Further it is preferred that after connector assembly facing surfaces 74,76 of upper and lower struts 50,52 clamp against upper and lower major surfaces 84,86 of cable 18. Forwardly facing surfaces 88 of struts 50,52 shown in FIG. 1 will act as rearward limits or stops engageable by terminals 16 after connector assembly; rounded recesses 90 in surfaces 88 are shown within which rearwardmost portions of terminals 16 are received (FIGS. 13 and 14).

Figure 3:
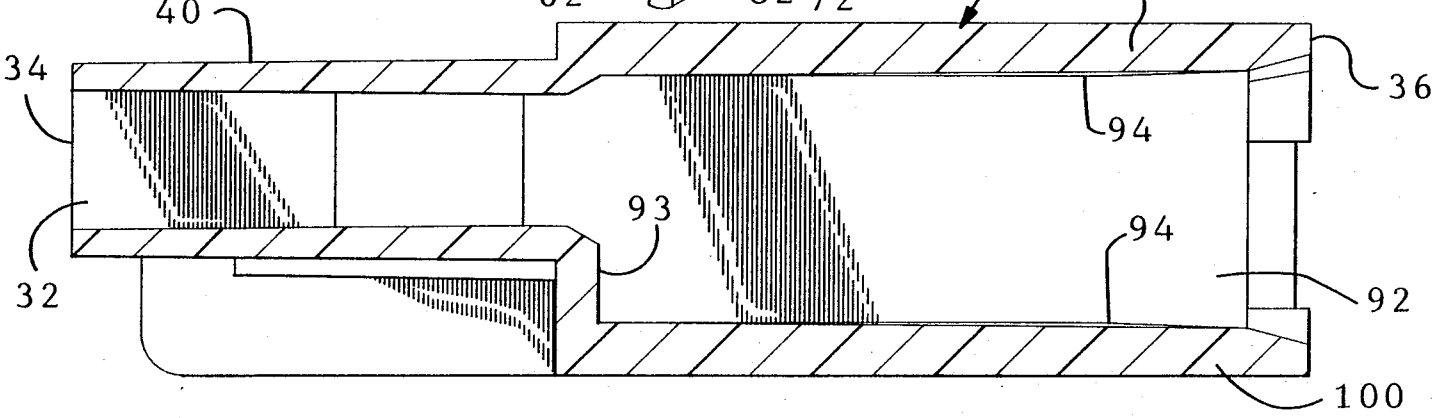
FIG. 3 is a longitudinal section view through the housing taken along lines 3—3 of FIG. 2.

Referring to FIGS. 2 and 3, a pair of large cavities 92 extend forwardly from rearward housing end 36 to rearwardly facing stop surfaces 93 to receive terminals 16 inserted thereinto. Pairs of upper and lower ledges 94 are defined axially along both sides of each cavity 92 between which terminals 16 will be disposed, with the distance between the facing ledge surfaces precisely selected so that after connector assembly terminals 16 will be allowed little vertical movement, if any, but allowing for some tolerance in the eventual height of terminals 16 which are terminated to cable 18 (FIGS. 13 and 14) Housing member 12 being integrally molded allows the distance between facing ledge surfaces to be precisely controlled. Vertical barrier wall 96 between cavities 92 disallows upper and lower cover sections 98,100 of housing 12 from slight spreading and thus maintains the distance between facing ledge surfaces of the inner pairs thereof.

Figure 4:
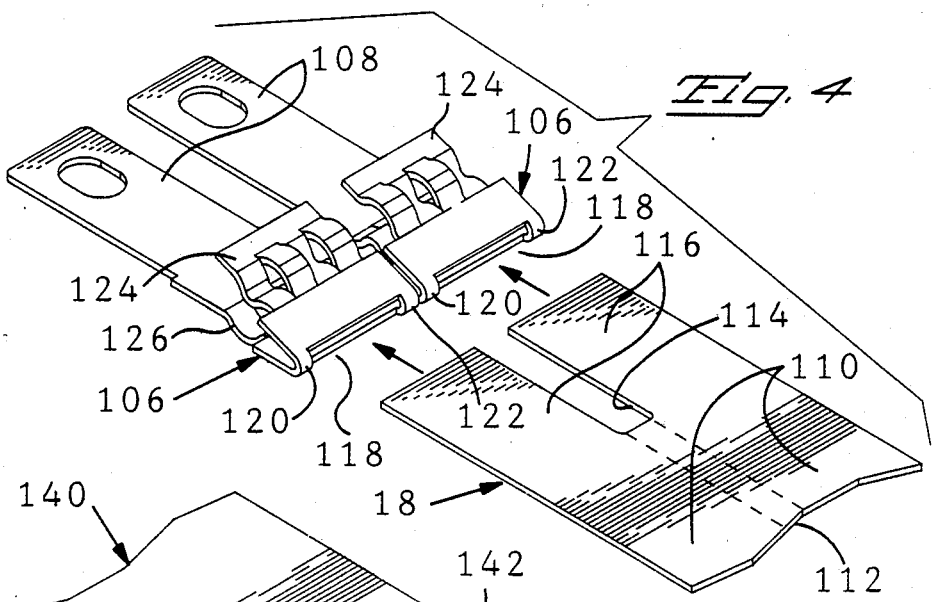
FIG. 4 is a perspective view of the terminals about to receive the prepared cable end for termination thereto, and showing an alternate type of contact section on the terminals.

Terminals 16 are of the type disclosed in Ser. No. 07/338,079 and include stamped and formed adapter members 102 disposed immediately against cable surfaces 84,86, and also preferably include insert members 104 secured along cable-remote surfaces of adapter members 102 and being of high copper content which establish gas-tight electrical engagement with sheared edges of the cable conductors after termination. FIG. 4 illustrates a pair of adapter members 106 having blade-like contact sections 108 of the type suitable for termination to terminal posts of a power supply; it is preferred that the terminals include insert members but such inserts are not shown in order to assist in illustrating the method of termination. Cable 18 includes two parallel spaced coplanar flat conductor members 110 therein coated by an insulative covering which also defines a medial portion 112 between the conductors 110. As shown cable 18 is prepared by cutting an axial slot 114 rearwardly from the cable end along the cable centerline, slot 114 having a selected width, thereby defining a pair of tab-shaped cable portions 116. Rearward ends 118 of adapter members 106 include a pair of bight sections 120,122 which join upper and lower plate sections 124,126 of adapter members 106.

Figure 5A:
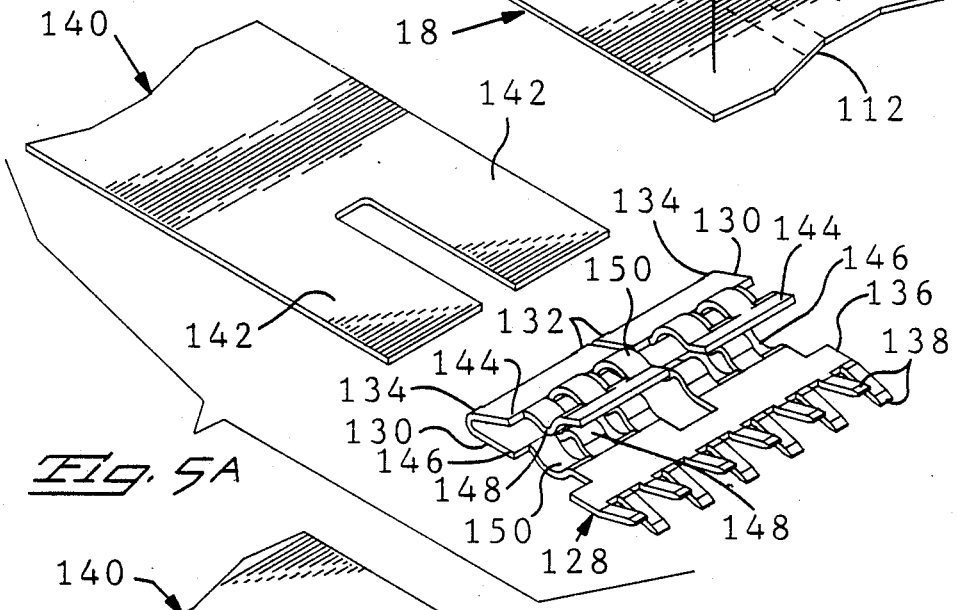
FIGS. 5A and 5B illustrate placing terminals on the cable end prior to termination, with insert members of the terminals not shown, and where the flat cable is a single conductor type and the terminals being integral across the contact sections.
Figure 5B:
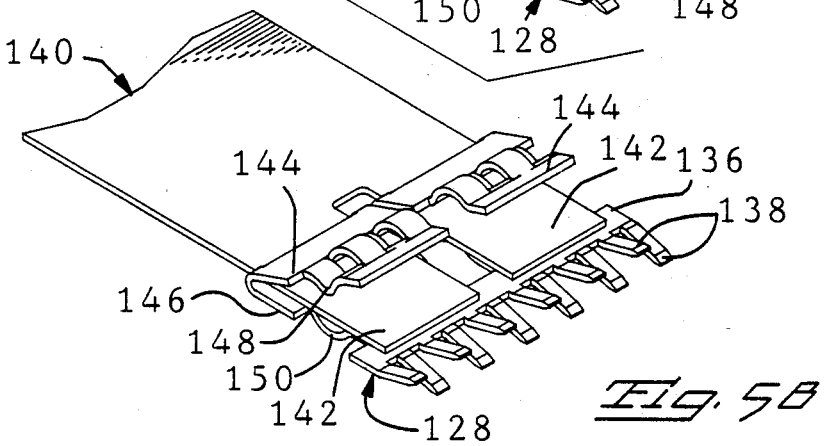

Referring now to FIGS. 5A and 5B, an alternate embodiment of adapter member 128 is shown having two adapter sections 130 each having a cable-receiving slot between pairs of bight sections 132 134. Adapter member 128 is integral across contact section 136 containing splines 138 and is suitable for terminating single conductor cable 140 which has been prepared similarly to cable 18 of FIG. 4 to have a pair of tab-shaped cable portions 142. Tab-shaped cable portions 142 are inserted into and through the cable-receiving slots until cable portions 142 are disposed between pairs of upper and lower plate sections 144,146. Defined transversely across upper and lower plate sections 144,146 are arrays of alternating shearing wave shapes 148 and relief recesses 150, similar to those disclosed in Ser. No 07/298,259, with wave shapes 148 extending toward upper and lower major surfaces of the flat cable.

Figure 6:
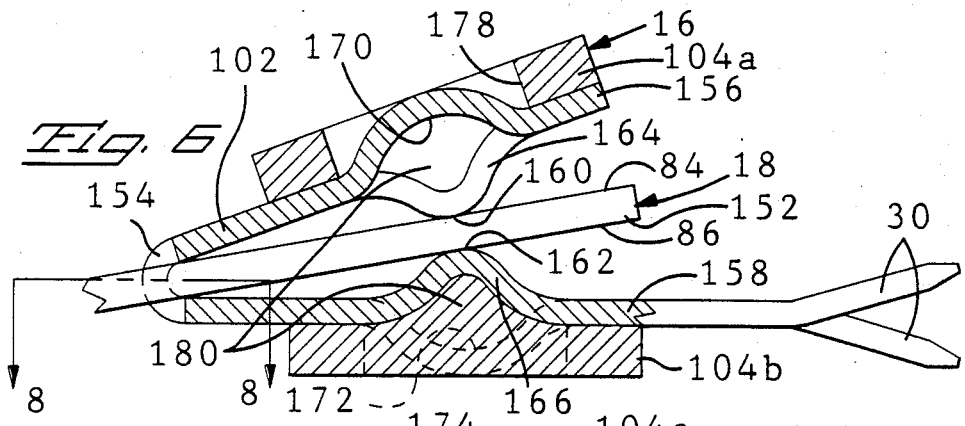
FIGS. 6 and 7 illustrate the terminals of FIG. 1 being terminated to the cable end.
Figure 7:
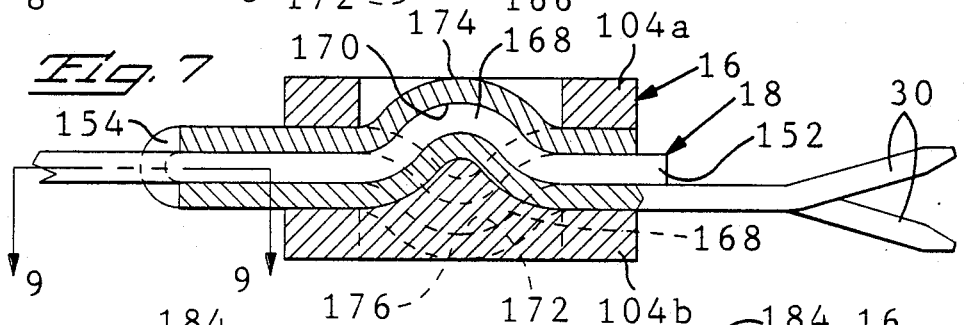

In FIGS. 6 and 7 a representative terminal 16 is shown having an adapter member 102 and upper and lower insert members 104*a*,104*b*, with a tab-shaped cable portion 152 extending through cable-receiving slot 154 and disposed between upper and lower plate sections 156, 158 of adapter member 102. Crests 160,162 of shearing wave shapes 164,166 of upper and lower plate sections 156,158 are shown against cable surfaces 84,86 prior to termination in FIG. 6; in FIG. 7, wave shapes 164,166 have sheared the conductor of cable 18 and have extruded the thus-sheared conductor strips 168 into the opposing relief recesses 170,172 to define alternating and interlocking upper and lower wave joints 174,176 disposed in respective apertures 178 of insert members 104. In FIG. 7 sheared conductor edges are disposed adjacent and in electrical engagement with the vertical wall surfaces simultaneously defining the sides of wave shapes 180 and longitudinal side walls of apertures 178 adjacent and alternating with wave shapes 180 transversely across upper and lower insert members 104*a*,104*b*. The wave joints may preferably be split by staking, and the insert members also staked along outwardly facing surfaces of wave shapes 180 to enhance the gas-tight nature of the electrical connections between the insert members and the sheared conductor edges by imparting stored energy in the wave joints.

Figure 8:
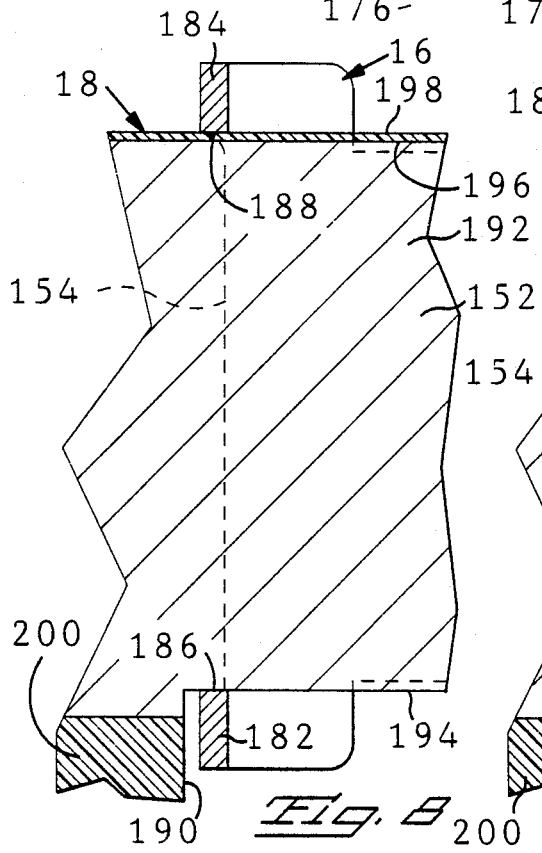
FIGS. 8 and 9 are section views taken along lines 8—8 and 9—9 of FIGS. 6 and 7 respectively, showing the terminals gripping the side edges of the cable end upon termination.
Figure 9:
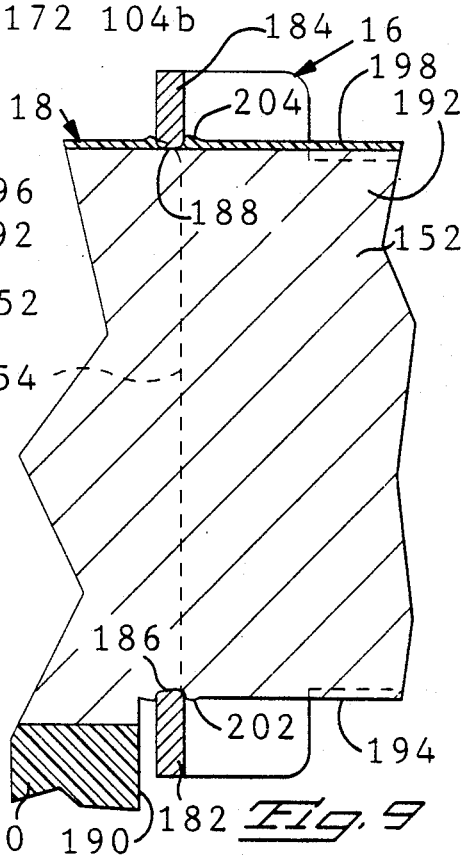

In FIGS. 8 and 9 can be seen the gripping of lateral edges of the tab-shaped conductor portions before and after termination of terminals 16 thereto, as disclosed in Ser. No. 07/338,079. Inner and outer bight sections 182,184 define cable-receiving slot 154 between facing edges 186,188 thereof. Cable 18 has been prepared as in FIG. 4 by cutting a slot 190 along the cable centerline, thereby shearing conductor 192 forming a sheared edge 194. Cable insulation 196 extends along lateral cable edge 198 and also defines medial strip 200 between the pair of conductors When upper and lower plate sections of the adapter member are pressed together as in FIG. 7, the metal of the bight sections 182,184 is deformed slightly and protrudes simultaneously against the conductor edge 194 and lateral cable edge 198 thereby biting into the metal of conductor 192 at 202 and compressing the insulation material 196 at 204 to grip the tab-shaped cable portion 152 and comprise an axial stop for terminal 16 along cable 18.

Figure 10:
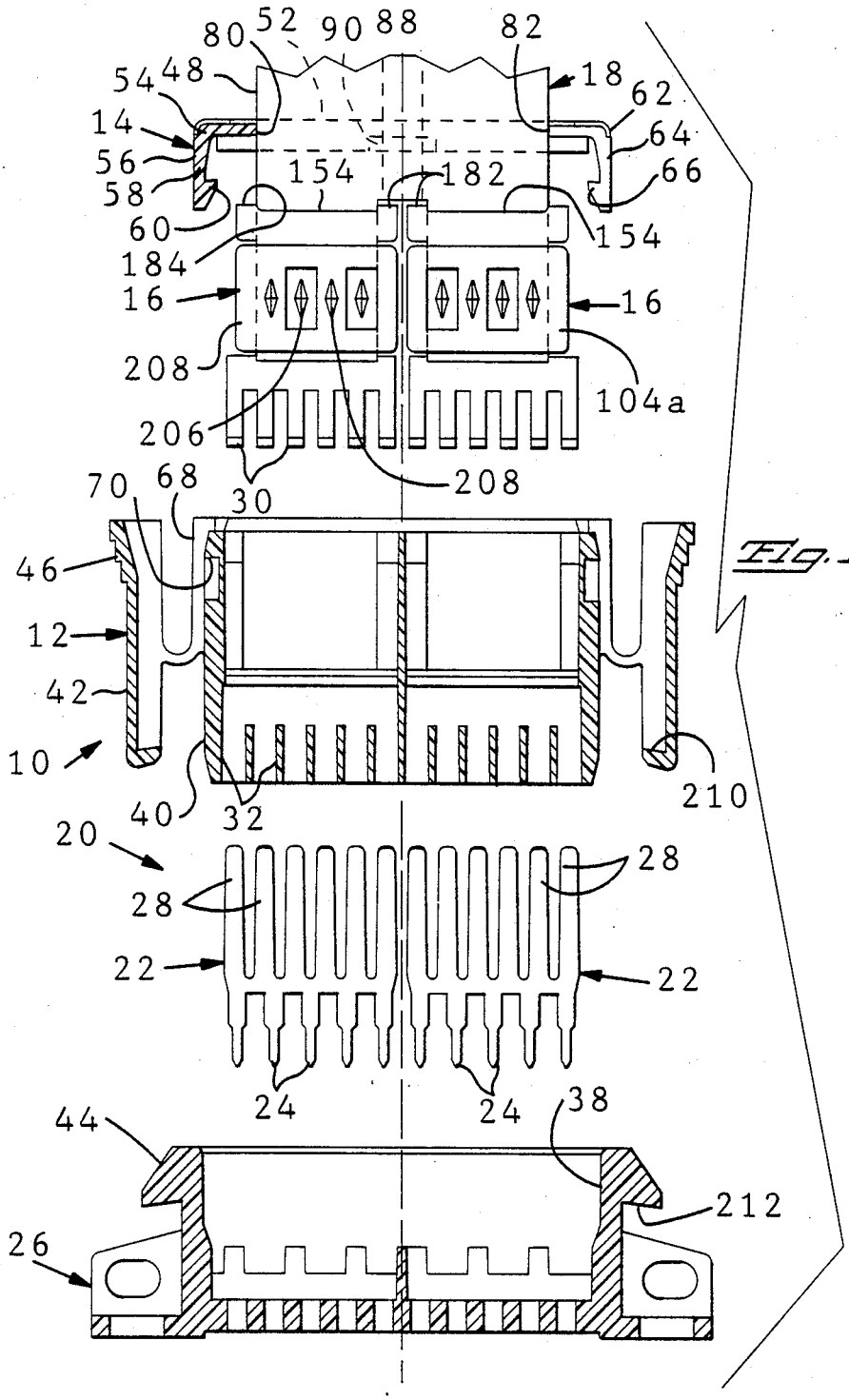
FIGS. 10 through 12 are plan section views of the mating connectors of FIG. 1 prior to securing the respective terminals in the housings, after terminal securing, and after connector mating, respectively.
Figure 11:
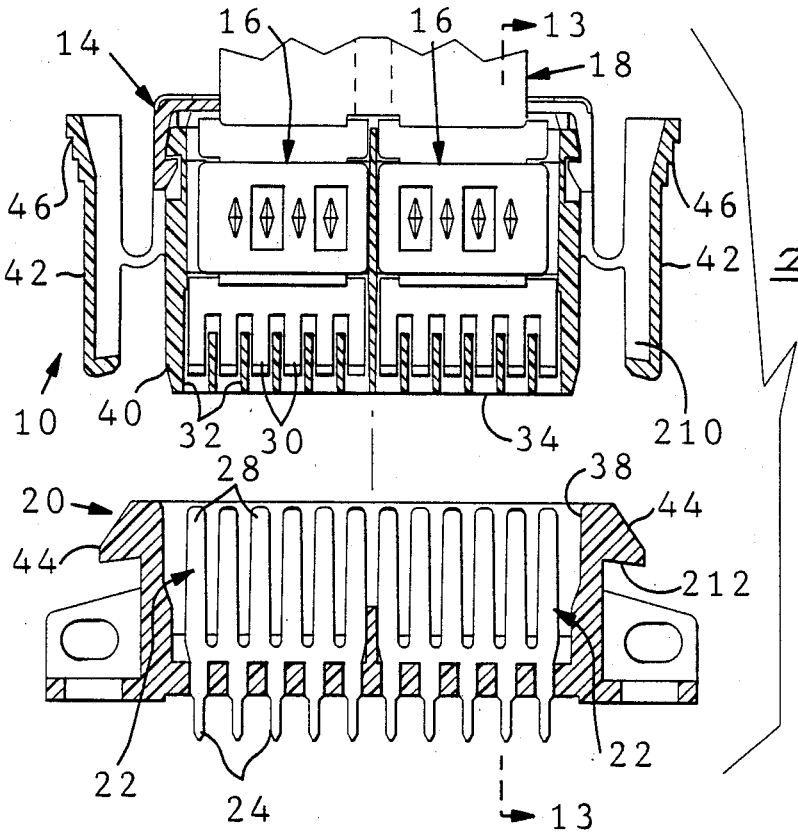
Figure 12:
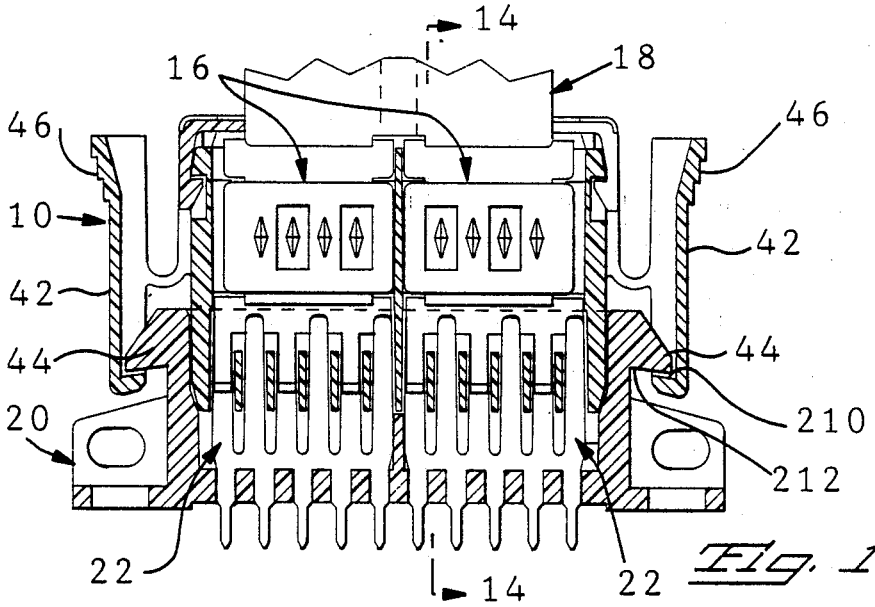

FIGS. 10 to 12 illustrate the assembly of connectors 10 and 20. Terminals 16 have been terminated to tab-shaped cable portions 152 including splitting the wave joints as indicated at 206 and staking the inserts between the wave joints as indicated at 208. Rearward cover member 14 has been inserted over cable 18 from lateral edge 48 in FIG. 10. In FIG. 11 terminals 16 have been inserted into cavities 92 of housing member 12 with splines 30 within passageways 32, and rearward cover member 14 has been latched to housing member 12 by latching projections 66 in latching recesses 70; terminals 22 have been secured in housing member 26 of connector 20 with contact sections 28 arrayed across cavity 38 and post sections 24 extending outwardly from housing member 26. In FIG. 12 connectors 10 and 20 are shown latched and mated together, with latching surfaces 210,212 of latch arms 42 and projections 44 having a slight reverse angle for vibration resistance; forward section 40 of housing member 12 has been received within cavity 38 of housing member 26 and with spring arm contact sections 28 of terminals 22 electrically engaged with splines 30 of terminals 16, alternating upwardly and downwardly across the terminals.

FIGS. 13 and 14 show connectors 10 and 20 being mated, with a downwardly angled spline 30*a* and an upwardly deflectable spring contact arm 28*a* electrically engageable together. Rearward cover member 14 is shown latched in place defining the cable exit with cable 18 clamped between facing surfaces 74,76 of upper and lower struts 50,52 and a bight section 184 of terminal !6 disposed in a recess 90.

Figure 15:
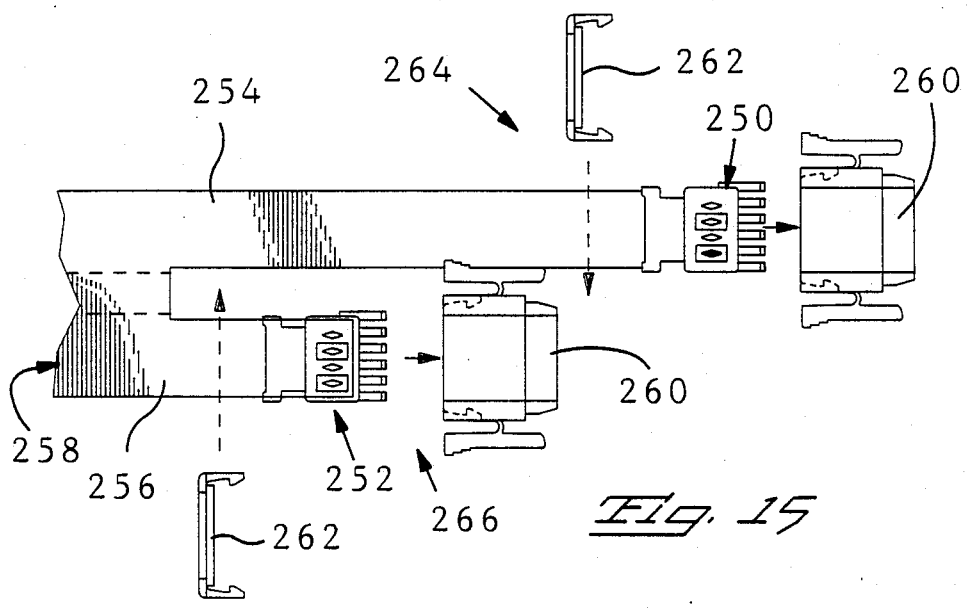
FIGS. 15 and 16 illustrate separate terminals and individual housings and rearward cover members for terminating dual conductor flat cable for relative axial spacing of the connectors, before and after insertion of the terminals into the respective housings.
Figure 16:
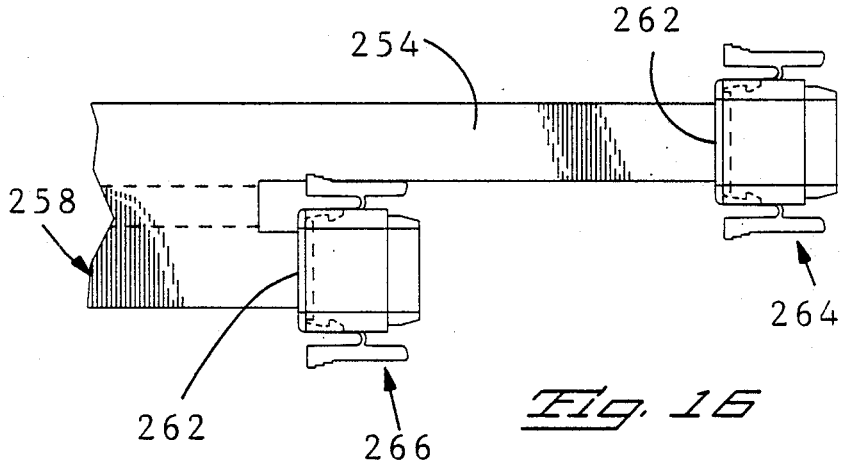
Figure 17:
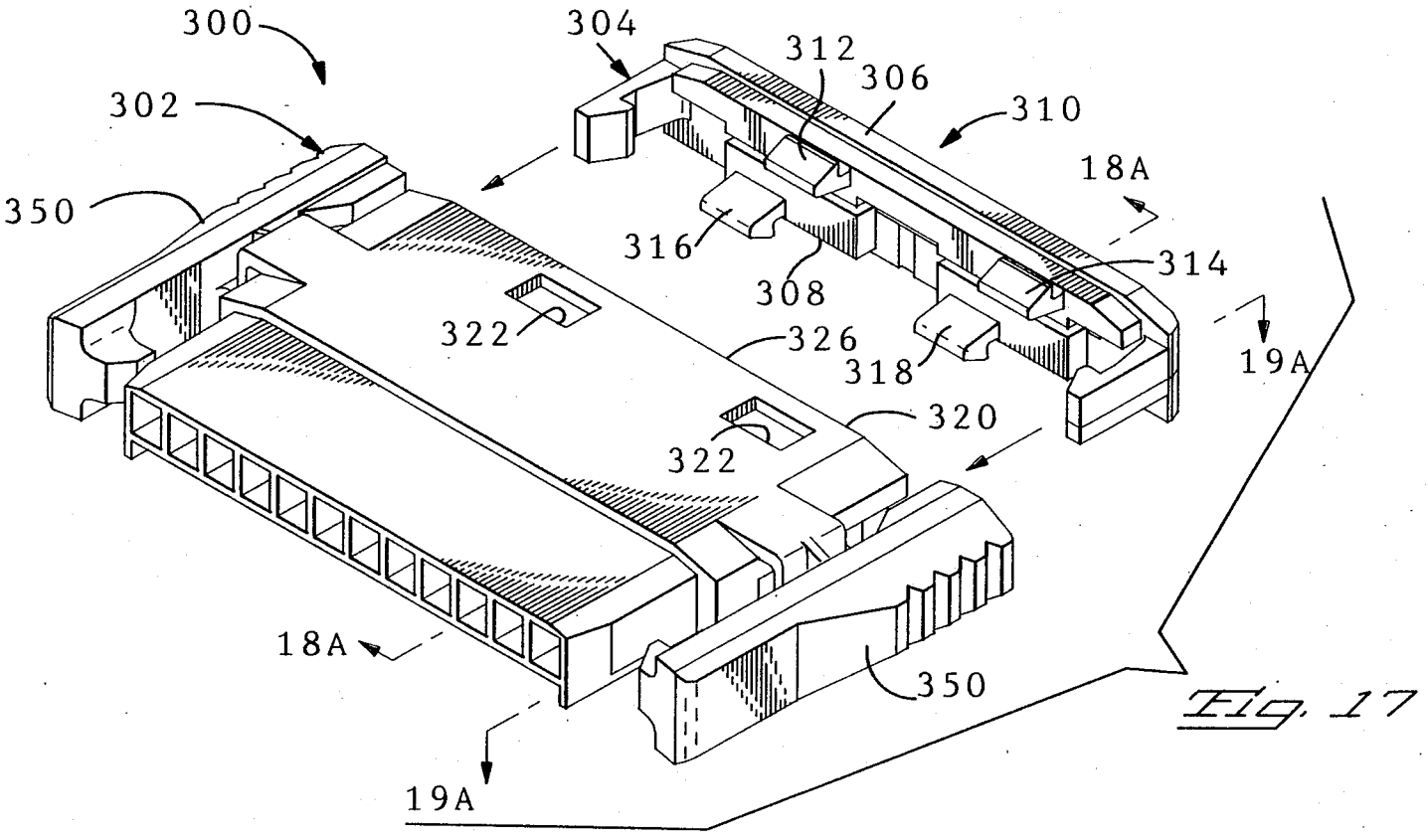
FIG. 17 is a perspective view of an alternate embodiment of rearward cover member of the present invention exploded from a corresponding housing member.

In FIGS. 15 and 16 are shown an alternate arrangement wherein terminals 250,252 are terminated to ends of respective cable portions 254,256 containing individual conductors of a dual conductor cable 258. Individual housing members 260 are shown for terminals 250,252, with individual rearward cover members 262 shown to be placed and latched to rearward ends of housing members 260. The arrangement shown accommodates the desire to space the connectors 264,266 apart for the power and return paths established by the individual conductors of the cable.

FIGS. 17 to 19B are directed toward another embodiment of housing assembly 300 comprising housing member 302 and rearward cover member 304. Upper and lower struts 306,308 of rearward cover member 304 are adapted to resist being deflected rearwardly at the central portion 310 and also upwardly and downwardly upon being stressed by a flat cable in the completed connector assembly. A pair of latching projections 312,314 are disposed forwardly of upper strut 306 at least slightly offset from the center, and a pair of latching projections 316,318 are disposed forwardly of lower strut 308 offset from projections 312,314 of upper strut 306 in order that rearward cover member 304 be capable of being secured to rearward housing end 320 in either orientation. Housing member 302 includes corresponding pairs of latching recesses 322,324 in the upper and lower cover sections 326,328, each located a small distance forwardly of rearward housing end 320. One pair of upper and lower latching recesses 322,324 is disposed on each side of vertical barrier wall 330 separating large cavities 332 which joins upper and lower cover sections 326,328 midway across the wide housing 302 providing a means to enable rearward cover member 304 to resist upper and lower deflection at central portion 310.

As seen in FIGS. 18A and 18B, each of the latching projections such as 314 is disposed on an arm 334 extending forwardly from a respective strut 306 or 308, with the latching projection defining a rearwardly facing latching surface 336 which is preferably angled slightly inwardly, and an outwardly and forwardly facing bearing surface 338. Bearing surfaces 338 facilitate securing rearward cover member 304 onto housing member 302 by engaging the rearward edges of upper and lower cover sections 326,328 and initiating deflection of the engaged cover portions outwardly by elastic deformation as latching projections 312,314,316,318 enter cavities 332. Latching projections ride over the inside surfaces of the deflected portions of upper and lower walls 326,328 until reaching latching recesses 322,324 at which time the deflected wall portions resile and the latching projections latch into corresponding ones of recesses 322,324. Preferably forwardly facing surface 340 of each latching recess is angled slightly outwardly to correspond to rearwardly facing latching surface 336 of the latching projection received into the recess; the slight angling of corresponding latching surfaces enables the central portion 310 of rearward cover member 304 to resist rearward deflection when subjected to cable stress by the terminals (FIGS. 13 and 14) terminated onto the flat cable and secured within the housing by the rearward cover member.

FIGS. 19A and 19B illustrate another configuration of latching arm 350 along each side 352 of housing 302 for latching engagement with a mating connector (not shown), such as is seen in FIGS. 1 and 10 through 12. An improved, durable stress-resistant and torque-resistant hinge joint 354 for integrally joining latching arm 350 to housing 302 is disclosed in greater particularity in Ser. No. 07/387,203 filed 7/21/89 (concurrently herewith) and assigned to the assignee hereof.

Variations and modifications may be made to the embodiments disclosed herein, which are within the spirit of the invention and the scope of the claims.

What is claimed is:

1. A housing assembly for terminations of terminal means to an end of flat power cable, comprising an integral housing member having upper and lower cover sections and a mating face and a terminal-receiving rearward end, and including terminal-receiving cavity means extending forwardly from said terminal-receiving rearward end to rearwardly facing stop surfaces said cavity means being adapted to receive said terminal means thereinto to adjacent said rearwardly facing stop surfaces from rearwardly of said housing member, and further including passageway means extending forwardly from said cavity means through which contact means of said terminal means extend after insertion to matingly engage corresponding contact means of another electrical article; and a rearward member securable onto said terminal-receiving rearward housing end after insertion of said terminal means into said terminal-receiving cavity means, said rearward member including a slot between upper and lower strut members, said slot having a width approximately equal to the width of the flat power cable and having a height at least after being secured to said terminal-receiving rearward housing end approximately equal to the thickness of the flat cable, and said rearward member defining forwardly facing stop surfaces corresponding to rearwardly facing stop surfaces of said terminal means, whereby after being secured to the housing member, the rearward member retains the terminal means terminated to the flat cable within the cavity means of the housing member, provides dielectric material closing the terminal-receiving rearward housing end, and the slot thereof defines a cable exit which is spaced rearwardly from terminations of the terminal means to flat cable which protects the terminations from cable torque relative to the housing member.

2. A housing assembly as set forth in claim 1 wherein said rearward member is bifurcated with said upper and lower struts being integrally joined at a joint at a first lateral end and separated at a second lateral end, whereby the rearward member is adapted to be inserted over the flat cable from a lateral edge thereof with said upper and lower struts respectively passing over and under upper and lower major surfaces of the flat cable rearwardly of the terminal means terminated to an end of the flat cable.

3. A housing assembly as set forth in claim 2 wherein said rearward member includes a first latch arm extending forwardly from said first lateral end and including first latching means at a forward end of said first latch arm, and further includes second latch arms coextending forwardly from said upper and lower struts at said second lateral end and having second latch means at respective forward ends thereof, said second latch arms comprising a cooperable latch arm pair opposed from said first latch arm, and said housing member including corresponding latching means along side walls thereof proximate said terminal-receiving rearward end adapted to establish latching engagement with said first and second latching means of said first latch arm and cooperable latch arm pair respectively when said rearward member is urged axially forwardly along the flat cable and against said terminal-receiving rearward housing end, securing said rearward member to said housing member and retaining said terminal means in said housing member.

4. A housing assembly as set forth in claim 3 wherein said cooperating latching means is adapted to hold said second latch arms of said cooperable latch arm after latching against movement relatively apart.

5. A housing assembly as set forth in claim 3 wherein said first and second latching means comprise latching projections extending relatively toward each other and define rearwardly facing latching surfaces, and said corresponding latching means comprise laterally outwardly facing latching recesses adapted to receive said latching projections thereinto upon latching and defining forwardly facing latching surfaces corresponding to said rearwardly facing latching surfaces to latchingly secure said rearward member to said housing member.

6. A housing assembly as set forth in claim 5 wherein said rearwardly facing latching surfaces are slightly angled outwardly and said forwardly facing latching surfaces are slightly angled inwardly, whereby the latching system defined by the rearward member and the housing member is adapted to hold the latch arms relatively toward the side surfaces and to thereby resist unlatching upon stress applied by the terminated flat cable urging said rearward member rearwardly from said housing member.

7. A housing assembly as set forth in claim 2 wherein said cable exit is defined by facing surfaces of said upper and lower struts spaced to abut the upper and lower major surfaces of the flat cable after assembly, and by inwardly facing surfaces defined on said integral joint at said first lateral end and on respective second lateral ends of said upper and lower struts after said rearward member is secured to said housing member, which are spaced to abut the lateral edges of the flat cable after assembly.

8. A housing assembly as set forth in claim 7 wherein rearward edges of said facing surfaces of said upper and lower struts are rounded.

9. A housing assembly as set forth in claim 1 for said terminal means comprising a pair of separate terminal members terminated onto respective tab-shaped portions of the flat cable, wherein said cavity means comprises a pair of cavities for respective ones of said pair of separate terminal members, said housing member including a central barrier wall between said pair of cavities establishing insulative material between the separate terminals after insertion thereof into said pair of cavities and joining said upper and lower cover sections of said housing midway thereof transversely, whereby the upper and lower cover sections are held a fixed spacing apart transversely thereacross along said terminal-receiving rearward end.

10. A housing assembly as set forth in claim 9 wherein pairs of upper and lower ledges are defined axially along inner surfaces of said upper and lower cover sections defining said pair of cavities and adjacent upper and lower surfaces of the terminals after insertion thereof into said cavities, said ledge pairs being disposed at both lateral ends of each of said pair of cavities, upper and lower ones of each of said pair of ledges having facing surfaces spaced apart a precise distance approximately corresponding to the nominal vertical height of each of the terminals of said pair, whereby the housing member maintains an assured effective vertical height to the respective cavities and vertical movement of the separate terminals is thereby closely limited.

11. A housing assembly as set forth in claim 1 wherein said upper and lower struts of said rearward cover member each include at least one latching projection extending forwardly therefrom to extend within said cavity means of said housing member and enter and latchingly engage a cooperating latching recess along said upper and lower cover sections respectively, said upper and lower cover sections thereby supporting said upper and lower struts of said rearward cover member to resist rearward upward and downward deflection of said upper and lower struts upon being stressed by the flat cable or the terminals terminated thereto.

12. A housing assembly as set forth in claim 11 wherein each said latching projection is disposed at a free end of an arm extending forwardly from a respective said strut, each said arm being deflectable inwardly by a respective said cover section as said latching projections rides over portions of said cover section prior to entering a respective said latching recess and latching.

13. A housing assembly as set forth in claim 12 wherein each said latching projection includes an angled forwardly and outwardly facing bearing surface to engage a rearward end of a respective said cover section upon initial engagement of said rearward cover member and said housing member during assembly, to initiate outward deflection of the engaged portions of said cover section.

14. A housing assembly as set forth in claim 11 wherein each said latching projection defines a rearwardly facing latching surface angled slightly inwardly, and each said latching recess defines a forwardly facing corresponding latching surface angled slightly outwardly.

15. A housing assembly as set forth in claim 11 wherein said upper strut includes a first pair of said latching projections and said lower strut includes a second pair of said latching projections, and said housing member includes corresponding first and second pairs of latching recesses, ones of each of said first and second pairs of latching projections and latching recesses being disposed on either side of a vertical barrier wall dividing said cavity means into separate cavities.

16. A housing assembly as set forth in claim 15 wherein ones of said first pair of latching projections and corresponding first pair of latching recesses, are offset from ones of said second pair of latching projections and corresponding second pair of latching recesses, whereby said rearward cover member is securable onto said rearward housing end in either of two opposing angular orientations.

* * * * *